US008695129B2

(12) United States Patent
Williams

(10) Patent No.: US 8,695,129 B2
(45) Date of Patent: Apr. 15, 2014

(54) PORTABLE BATHTUB APPARATUS

(76) Inventor: Lavada G. Williams, Rancho Cordova, CA (US)

( * ) Notice: Subject to any disclaimer, the term of this patent is extended or adjusted under 35 U.S.C. 154(b) by 662 days.

(21) Appl. No.: 11/724,164

(22) Filed: Mar. 15, 2007

(65) Prior Publication Data

US 2008/0282462 A1 Nov. 20, 2008

(51) Int. Cl.
*A47K 3/06* (2006.01)
*A47K 3/00* (2006.01)

(52) U.S. Cl.
CPC ..... *A47K 3/00* (2013.01)
USPC ..... 4/585

(58) Field of Classification Search
CPC ..... A47K 3/00
USPC ..... 4/585, 588, 580–581; 5/706
See application file for complete search history.

(56) References Cited

U.S. PATENT DOCUMENTS

| | | | | | |
|---|---|---|---|---|---|
| 2,432,147 | A * | 12/1947 | Freund | 5/604 |
| 2,471,302 | A * | 5/1949 | Boward | 4/588 |
| 4,068,326 | A * | 1/1978 | Deschler | 4/541.3 |
| 4,312,084 | A * | 1/1982 | Browning | 4/538 |
| 4,744,112 | A * | 5/1988 | Keesling, Jr. | 4/585 |
| 4,821,348 | A * | 4/1989 | Pauna | 4/547 |
| 5,025,515 | A * | 6/1991 | Rhines | 4/585 |
| 5,247,712 | A * | 9/1993 | Williams | 4/585 |
| 5,341,526 | A * | 8/1994 | Kennedy | 4/584 |
| 6,543,068 | B1 * | 4/2003 | Penninger | 4/585 |

* cited by examiner

*Primary Examiner* — Lori Baker
(74) *Attorney, Agent, or Firm* — Theodore J. Biden, Jr.

(57) ABSTRACT

A portable bath tube apparatus utilizing a flexible sheet having a bottom and a side portion extending from the bottom. An envelope is also included and is capable of containing air to form a chamber with respect to the bottom of the flexible sheet. The sheet is anchored to a bed and includes a valve for permitting the envelope to be inflated with air pressure. A fastener maintains the envelope in a compact form when the envelope lies in a deflated configuration relative to the bed.

3 Claims, 2 Drawing Sheets

PORTABLE BATHTUB APPARATUS

BACKGROUND OF THE INVENTION

The present invention relates to a novel in useful portable bathtub apparatus.

Bed ridden patients require care including provision of food, and water and maintaining a high degree of cleanliness in a hospital environment. Among such needs is the provision of bathing a patient, which is especially difficult when the patient is immobile. In the past, sponge baths have been administered by caregivers, but such a cleaning procedure is not as thorough as providing the patient with a bath or shower in a bathroom facility. Unfortunately, it is quite difficult to move patients back and forth for a bath to achieve these results. In many instances a patient may be further injured during this process, since a bathtub becomes slippery when water is placed in the same.

A novel bathtub apparatus which is portable and usable in conjunction with a bed, particularly a hospital bed, would be a notable advance in the medical arts.

BRIEF SUMMARY OF THE INVENTION

In an accordance with the present invention a novel and useful portable bathtub apparatus is herein and provided.

The apparatus of the present invention utilizes a flexible sheath of material. Typically the sheath of the material would be a polymeric material having water containing properties. The flexible sheath possesses a bottom and a side portion extending from the bottom. An envelope is formed in the flexible sheath to contain air in order to allow the flexible sheath to assume an upright configuration in order to form an open chamber relative to the bottom. The open chamber would, of course, be capable of holding water in order to bath a subject.

A anchor is also employed for securing a portion of the flexible sheet to the bed. Of course, the flexible sheet maybe positioned or stored in other ways and not be secured to a bed in many cases. The anchor may take the form of a strip connected to the flexible sheet which is capable of lying beneath the portion of the bed, such as a place beneath the mattress of the bed which would then hold the flexible sheet in place by its weight.

A valve is also used for permitting the envelope to assume an inflated configuration by communication with a source of air pressure. Likewise, the envelope may be deflated by removal of air from the same.

A fastener may also be employed to maintain the envelope in a roll, in a folded, or in other compact forms when the envelope is deflated and the flexible sheath is not being used as a bathtub apparatus. Such fastener may take the form of one or more straps, a case, and the like.

In addition, the bottom portion of the flexible sheath may include a cushion material and may also be inflated into an envelope forming the bathtub configuration. In this regard, the bottom portion may include a second envelope to achieve this result. A valve inflating the first envelope may also inflate the second envelope if the two envelopes are interconnected.

It may be apparent that a novel and useful bathtub apparatus has been hereinabove described.

It is therefore an object of the present invention to provide a portable bathtub apparatus which maybe used with a hospital bed in order to easily and conveniently bath a patient.

A further object of the present invention is to provide a portable bathtub apparatus which is useable in a hospital bed and permits the positioning of a patient within the bathtub without undue effort.

A further object of the present invention is to provide a portable bathtub apparatus which is useable as a bathtub on a bed and maybe stored in a compact manner.

A further object of the present invention is to provide a portable bathtub apparatus which is useable with a bed and includes a provision for connecting the bathtub apparatus to the bed in an extended or compact configuration.

Yet another object of the present invention is to provide a portable bathtub apparatus which may be used in conjunction with a bed to bathe a bedridden person and be inflated for use and deflated following use for storage and a compact configuration.

Another object of the present invention is to provide a portable bathtub apparatus which is easy to manufacture, use, and repair.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
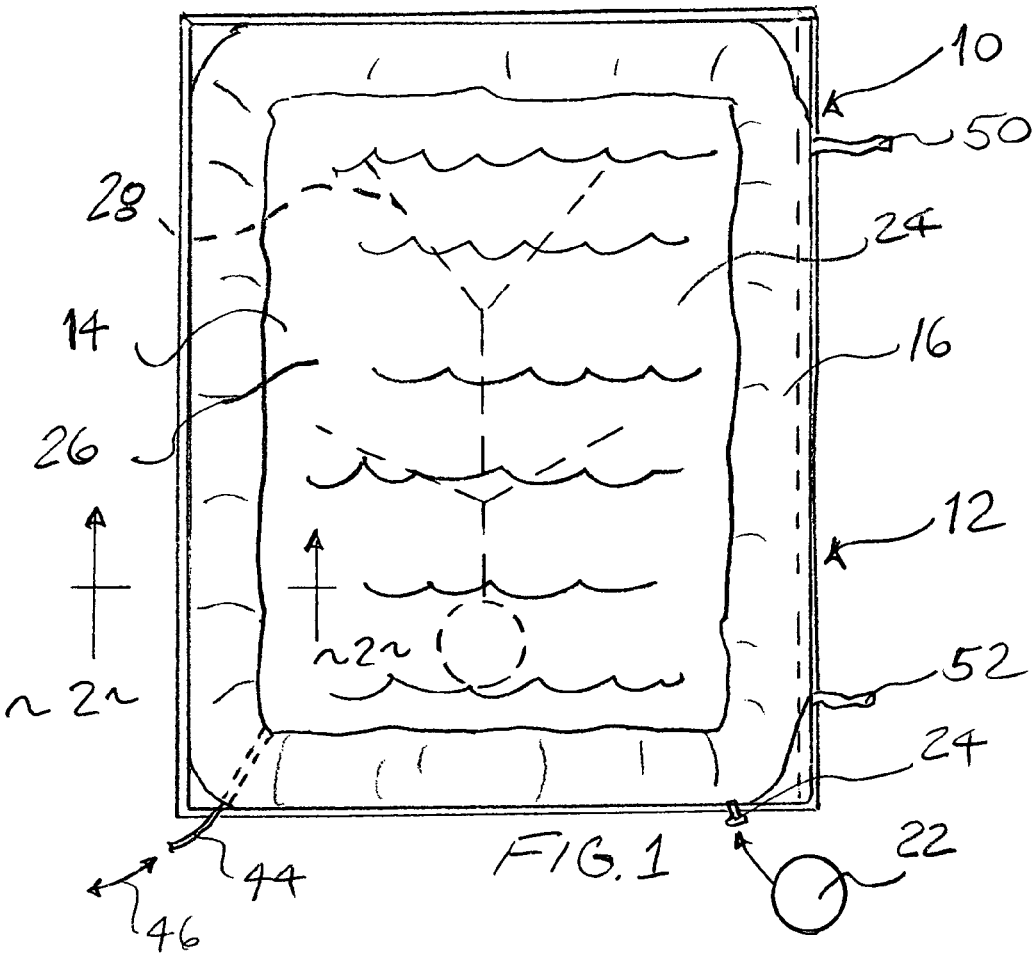
FIG. 1 is a top plan view of the apparatus of the present invention.
Figure 2:
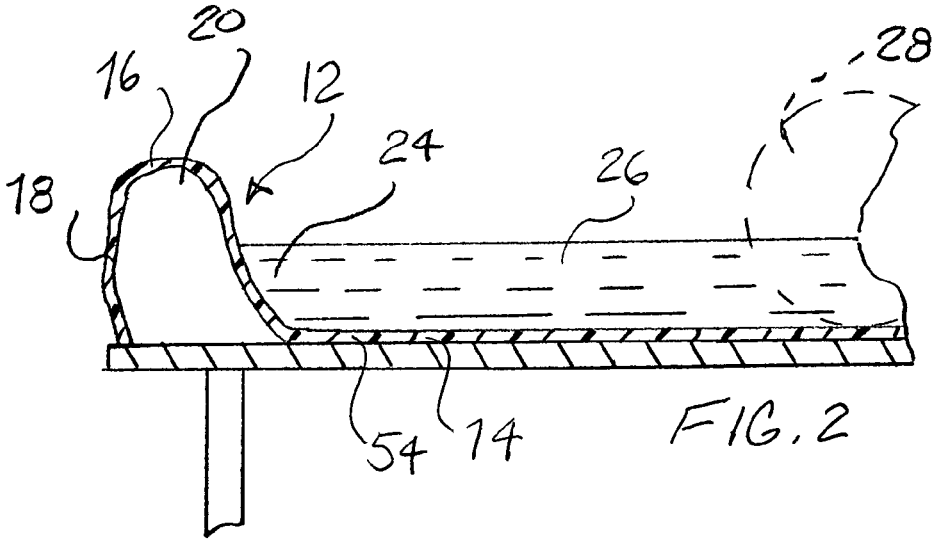
FIG. 2 is a sectional view taken along line 2-2 of FIG. 1.

An embodiment of the invention is depicted in the drawings by reference character 10. The portable bathtub apparatus of the present invention 10 includes in one of its elements a flexible sheet 12. Flexible sheet 12 possesses a bottom 14 with a side portion 16 extending therefrom, FIGS. 1 and 2, Side portion 16 further includes an envelope 18 having an inner space 20 which is capable of receiving air from a source of air pressure 22. Source of air pressure 22 maybe a compressor, air pump, and the like. Valve 23 permits envelope 18 to assume an inflated configuration by communication with air source 22. Needless to say, valve 23 also permits envelope 18 to assume a deflated configuration, which will be discussed hereinafter, FIG. 2. When side portion 16 is inflated, as is depicted in FIGS. 1 and 2, an open chamber 24 is formed. Chamber 24 is capable of holding a body of water 26 and which may be used to bathe a subject 28, depicted as a stick figure in FIGS. 1 and 2.

Figure 3:
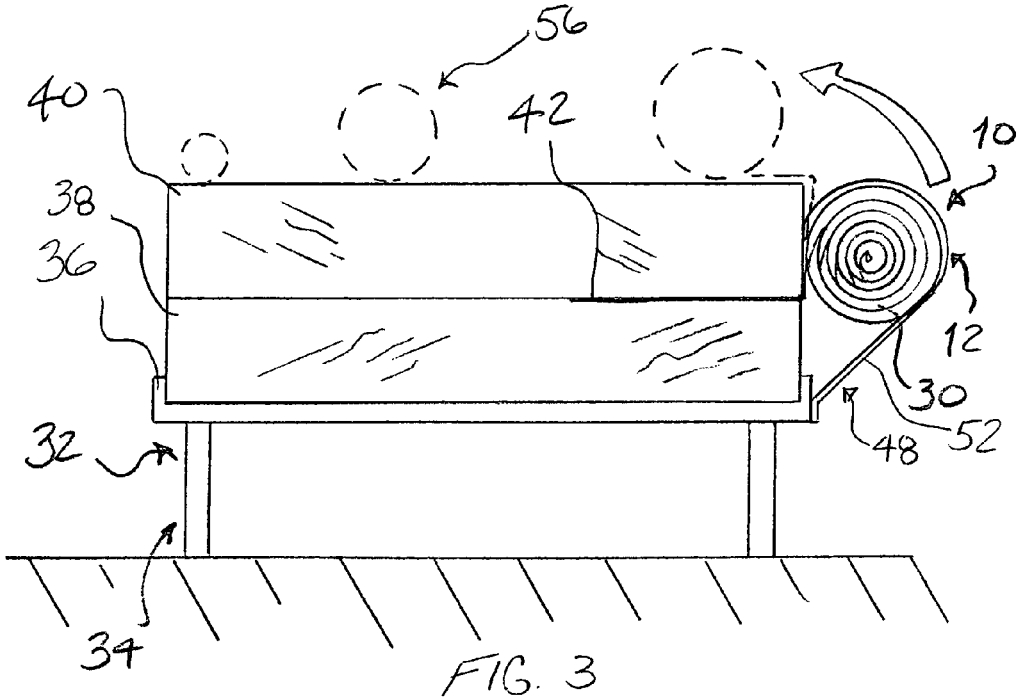
FIG. 3 is a end elevational view of the apparatus of the present invention in a compact configuration.

With reference to FIG. 3, it may be observed that apparatus 10 may assume in a compact configuration such as roll 30. In addition, apparatus 10 is usable with a bed 32 having a plurality of legs 34, two of which are depicted in FIG. 3. A frame 36 supports a box spring section 38 and a mattress section 40. Of course, bed 32 may take various configurations such as one that does not include a box spring. Apparatus 10 further includes an anchor 42 in a form of a strip which attaches to flexible sheet 12. Anchor 42 is able to fit beneath mattress 40 and above box spring 38. In any case, anchor 42 secures flexible sheet to bed 32 by lying beneath a portion of bed 32. Also, anchor 42 may not be necessary or may take other forms such as clamps, clips, bases, and the like.

Figure 4:
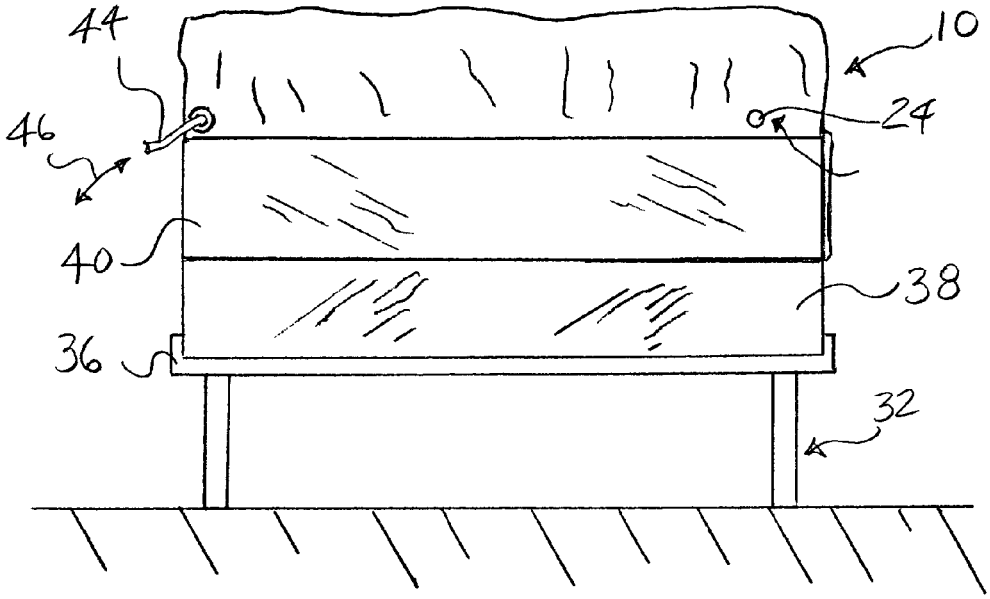
FIG. 4 is a end elevational view of the apparatus of the present invention in its inflated configuration.

It should also be pointed out, that inlet/outlet tube 44, FIGS. 1 and 4, permits the filling and draining of water relative to chamber 24 of apparatus 10. Directional arrow 46 indicates this operation. Of course, other methods may be used to fill and to drain chamber 24 such as using exterior conduits, bucket containers, and the like.

Fastener 48 is also employed in the present invention for maintaining flexible sheet in a compact form when envelope 18 lies in a deflated configuration. Fastener 48 is shown as a pair of straps 50 and 52, FIG. 1, which are detachably connected to bed frame 36 and to mattress 38.

Bottom 14 of flexible sheet 12 may also be inflated at the same time as envelope 16. In an addition, bottom 14 may be formed of a Cushion type of material. More over, cushioning material and inflation may be employed together in order to soften the contact with bottom 14 by patient 28. In this regard, second envelope 54 of bottom 14 may be inflatable.

In operation, the user unravels flexible sheet 12 by removing straps 50 and 52 of anchor 42. Flexible sheet 12 unrolls as it indicated by the phantom circles 56 atop mattress 40 of FIG. 3. The patient 28 lying in bed 32 would then be rolled over the top of flexible sheet 12 prior to the complete unrolling of flexible sheet 12. Air from air pressure source 22 would then be sent into envelope 18 and possible envelope 54. Such delivery of air would inflate apparatus 10 as shown in FIG. 4. Water would then be forced through inlet/outlet tube 44 to fill chamber 24 with the requisite amount of water 26. The patient 28 may then be bathed without the patient ever leaving bed 32. A reverse procedure would follow to remove tub apparatus 10 from bed 32.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A portable bathtub apparatus in combination with a bed and a source of air pressure, comprising:

a. a flexible sheet, having a bottom and a side portion extending from said bottom, said side portion further comprising an envelope, said envelope being capable of containing air and forming a chamber with said bottom, said flexible sheet being capable of assuming a compact form in a deflated configuration;

b. an anchor, said anchor connected to said flexible sheet and securing said flexible sheet to the bed, said anchor comprising a strip connected to said flexible sheet, said strip being formed to lie beneath a portion of the bed.

c. a valve for a permitting said envelope to assume an inflated configuration by communication with said source of air pressure and said deflated configuration upon removal of air from said envelope;

d. fastener for maintaining said flexible sheet in said compact form when said envelope lies in said deflated configuration, said fastener holding said flexible sheet, in said compact form, to the bed; and e. a fastener for holding said flexible sheet to the bed.

2. The apparatus of claim 1 which additionally comprises a cushion forming said bottom of said flexible sheet.

3. The apparatus of claim 1 in which said envelope comprises a first envelope and which additionally comprises a second envelope forming at least a portion of said bottom of said flexible sheet, said second envelope being capable of containing air.

* * * * *